United States Patent [19]

Niina

[11] Patent Number: 4,768,453

[45] Date of Patent: Sep. 6, 1988

[54] WATERCRAFT

[75] Inventor: Jiro Niina, Nishi, Japan

[73] Assignee: Kawasaki Jukogyo Kabushiki Kaisha, Kobe, Japan

[21] Appl. No.: 857,992

[22] Filed: May 1, 1986

[30] Foreign Application Priority Data

May 8, 1985 [JP] Japan ..... 60-98789

[51] Int. Cl.[4] ..... B63B 1/00

[52] U.S. Cl. ..... 114/56; 440/38

[58] Field of Search ..... 114/56, 315, 270, 38, 114/144 R

[56] References Cited

U.S. PATENT DOCUMENTS

| | | | |
|---|---|---|---|
| Re. 30,978 | 6/1982 | Jacobson | 114/270 |
| 3,369,518 | 2/1968 | Jacobson | 114/270 |
| 3,790,977 | 2/1974 | Bombardier et al. | 114/270 |
| 3,890,920 | 6/1975 | Buelk | 114/315 |
| 4,681,058 | 7/1987 | Nishida | 114/56 |

FOREIGN PATENT DOCUMENTS

| | | |
|---|---|---|
| 2133003 | 11/1972 | France . |
| 2338186 | 12/1977 | France . |
| 54-30197 | 9/1979 | Japan . |

*Primary Examiner*—Sherman D. Basinger
*Assistant Examiner*—Edwin L. Swinehart
*Attorney, Agent, or Firm*—Marshall, O'Toole, Gerstein, Murray & Bicknell

[57] ABSTRACT

A relatively small water craft having a center of gravity and which when in the water, has a draft line. The craft comprises a hull having a fore portion and an aft portion, the fore portion including an engine compartment and two sides and the aft portion including an operator's platform. One of the two sides has motion-resistance means thereon in the area of the draft line when an operator is absent from the platform. The motion resistance means on the one side produces unbalanced resistances on the two sides, causing the boat to circle when running without an operator.

1 Claim, 2 Drawing Sheets

WATERCRAFT

FIELD AND BACKGROUND OF THE INVENTION

This invention relates to water-jet-propelled recreational watercrafts which are small and light weight in relation to the size and weight of the typical operator.

This type of craft is generally used for recreational or leisure activities, and, because they are designed with the engine and other major parts contained in the front part of the craft and with a platform near the rear part of the craft for the operator, such manuevers as high-speed motion and sharp turns can only be performed while the operator is in the riding position and thus provides an overall balance of weight. In such a watercraft, the draft line differs dramatically when the operator is riding and the craft is in motion and when the craft is simply floating on the surface of the water.

Thus this type of craft is so designed as to be a system that is operated while the operator skillfully achieves a balance between himself and the craft.

Moreover, from a structural point of view of the craft itself, in order to both prevent the craft from sinking in the event that the operator falls off during operation and also to provide the craft with the ability to automatically reright itself after being capsized, various parts of the craft from the center to the stern area where the operator rides are filled with foam material to increase flotation. The craft's center of gravity (without an operator) is located toward the prow where the engine is located, and when there is no operator on the craft and it is simply floating on the surface of the water, the craft is trim with the prow at least partially submerged beneath the water surface. Thus, the draft line when the craft is simply floating on the surface of the water differs greatly from that during operation.

Therefore, with this type of watercraft, if the operator falls off into the water during operation, the craft immediately trims itself with the prow at least partially submerged beneath the surface of the water, thus creating a sudden increase in motion resistance; further, when the operator releases the controls, the craft continues its motion with the engine automatically maintained at idle setting. In this case, if the operator falls off the craft during operation, the craft will continue to move in an undetermined direction.

Thus, for this type of craft a mechanism has been proposed which, in the event that the operator falls off the craft, would automatically turn the steering nozzle of the craft's jet propulsion device in a fixed direction in order to cause the craft to automatically circle in the vicinity where the operator fell off, and thus facilitate recovery of the craft. Such an arrangement is described in Japanese Patent Pub. No. SHO. 54-30197.

However, when the aforementioned mechanism is used on such a craft, it has been found that, at the moment that the operator falls off the craft, the craft assumes a posture with its stern floating high in the water and the steering nozzle sprays the jet of water close to the surface of the water and in a particular direction. This situation thus limits the effectiveness of such a mechanism.

It is a general object of this invention to avoid the foregoing problems, by creating a difference, between the left and right sides of the craft, in the inherent motion resistance which occurs at the draft line, thus achieving a small watercraft with an extremely effective circling function without relying on a steering nozzle mechanism located at the stern of the craft.

SUMMARY OF THE INVENTION

A watercraft in accordance with the present invention comprises a hull having fore and aft portions, an engine mounted in the fore portion of said hull and said hull forming a platform adjacent said aft portion, said platform being adapted to support an operator of the craft, and motion resistance means on one side of said fore portion of said hull, said resistance means being adapted to be at least partially below the surface of the water when an operator is not on said platform.

BRIEF DESCRIPTION OF THE DRAWINGS

The invention will be better understood from the following detailed description taken in conjunction with the accompaning figures of the drawings, wherein.

DETAILED DESCRIPTION

Figure 1A:
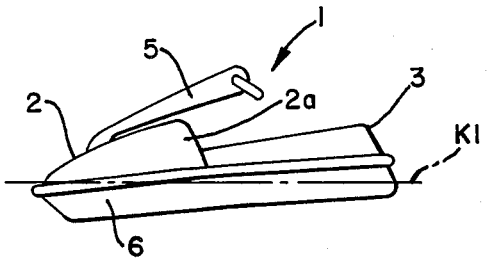
FIGS. 1A and 1B show the floating conditions of a watercraft in accordance with this invention.
Figure 1B:
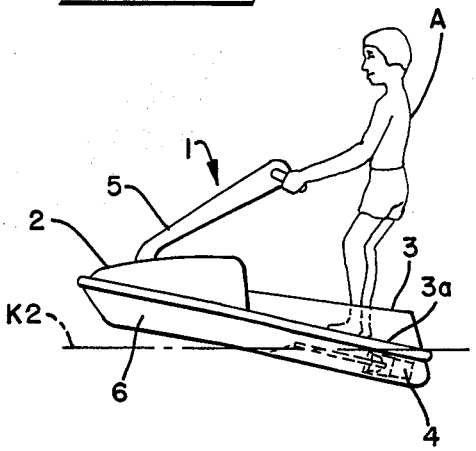

FIGS. 1A and 1B show the floating conditions of a watercraft incorporating this invention. The boat includes a hull 1 which forms a prow or fore part 2, and a stern or aft part 3. In the prow 2 is an enclosure **2*a* which houses the engine, fuel tank, and other major parts (not shown), which may be conventional. The steering nozzel 4 of the craft's water jet propulsion system is located at the stern 3. The water is drawn in through an intake port in the underside of the craft, is compressed and jetted out of the steering nozzle 4 by an impeller which is driven by the engine. The propulsion force is generated as a reaction to this jet of water. In addition, an operator A rides on an operation platform or floor 3*a* located at the stern 3 of the craft 1, and holds of a control handle 5 in both hands, and he operates the handle 5 in order to swing the steering nozzle 4 left or right and thus steer the boat 1**. The foregoing basic structure of this type of craft is well known.

Furthermore, FIG. 1A shows the craft 1 simply floating on the surface of the water with no operator on the platform **3*a*. In this condition, due to distribution of the weight (the engine, fuel etc. at the prow), the craft 1 is trim and the draft or water line K1 is achieved with the prow 2 of the craft 1 submerged below the surface of the water. FIG. 1B shows the condition of the same craft 1 during normal operation with an operator A riding it; in this condition the craft 1 is trim and the draft line K2 is achieved with the prow 2 raised considerably above the surface of the water. Further, in FIG. 1A the stern and the nozzle 4 are relatively high in the water, whereas in FIG. 1B** they are relatively low in the water.

In accordance with this invention, a motion-resistance means 7 is provided on one of the sides 6 of the craft, in the prow portion and in the area of the draft line K1 as it exists while the craft is floating on the surface of the water under its own weight (without a rider as shown in FIG. 1A).

Figure 2:
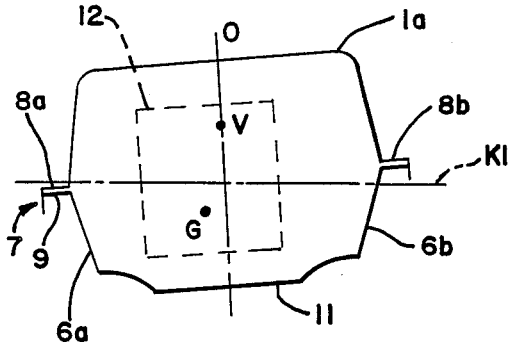
FIG. 2 is a cross-sectional view of the hull of a craft in accordance with a first embodiment of this invention.

FIG. 2 is a cross-sectional view of the hull of a craft according to a first embodiment of this invention. In this craft, the hull is formed by a bottom part 11 and an upper shell part 1*a*. The two parts are joined by outwardly extending flanges 8*a* and 8*b* which extend horizontally out from the hull and divide the sides 6*a* and 6*b* of the craft at the prow 2 in two vertically spaced parts. The shell flanges 8*a* and 8*b* include a generally horizontal part and a generally vertical part in cross-section thereby forming downwardly opening channels 9 between the flanges and the sides 6*a* and 6*b* of the craft. In this construction the flanges 8*a* and 8*b* and the channels on the two sides 6*a* and 6*b* are essentially the same.

Moreover, with this embodiment, the center of gravity G (FIG. 2) of the craft (without an operator) is set at a point which is shifted to one side from the vertical plane V containing the longitudinal axis line 0 of the hull. This is preferably accomplished by offsetting the engine and/or the fuel tank to one side sufficiently far to cause the flanges 8*a* at the prow to be below the water line. This is shown by the dashed line representation of the engine 12 in FIG. 2. Thus, when the craft is floating on the surface of the water with no operator riding on it, the hull heels to one side and the side shell flange 8*a* on the one side of the prow is submerged in the water further than the side shell flange 8*b* on the other side. In this way, a difference is created in the motion resistances of the left and right sides 6*a* and 6*b* resulting from submersion of these shell flanges 8*a* and 8*b*, and the shell flange 8*a* with the greater motion resistance thus forms the motion-resistance means 7 of the invention.

As previously mentioned, an example of one method of shifting the center of gravity G of the craft to one side is to shift the location of the engine, fuel tank, or other major part to one side of the center; however, other methods may also be employed, such as adding weights to one side.

Figure 4:
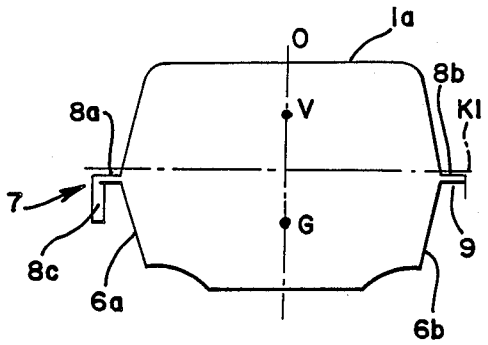
FIG. 4 is a sectional view taken on the line 4—4 of FIG. 3.
Figure 3:
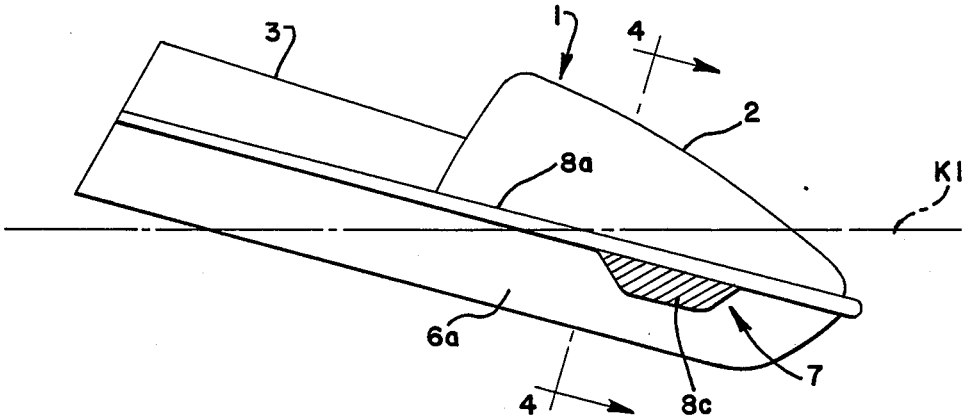
FIG. 3 is a side view of a craft illustrating a second embodiment of this invention.

Similarly to first embodiment, the embodiment shown in FIGS. 3 and 4 also include a craft 1 whose hull includes shell flanges 8*a* and 8*b* which extend horizontally outwardly and divide the sides 6*a* and 6*b* at the prow 2 into upper and lower parts. However, with this embodiment, the center of gravity G of the craft is set at a point within the vertical plane V containing the axis line 0 of the hull. When the hull of the craft is trim while it is floating on the surface of the water without an operator, the hull is balanced left and right and the shell flanges 8*a* and 8*b* on the sides 6*a* and 6*b* are equally submerged in the water, as shown in FIG. 4. However, with this embodiment, a modified shell flange 8*c* is provided on one side so that the shell flange 8*a* on one side is asymmetrical with the shell flange 8*b* on the other side. However both shell flanges are submerged below the surface of the water when an operator is not on the platform 3*a*. This modified shell flange 8*c* creates a difference in the submerged motion resistances of the left and right shell flanges 8*a* and 8*b*, and thus the flange 8*c* forms the motion-resistance means 7 of the invention. The modified shell flange 8*c* is normally out of the water when an operation is riding on the craft.

Figure 5:
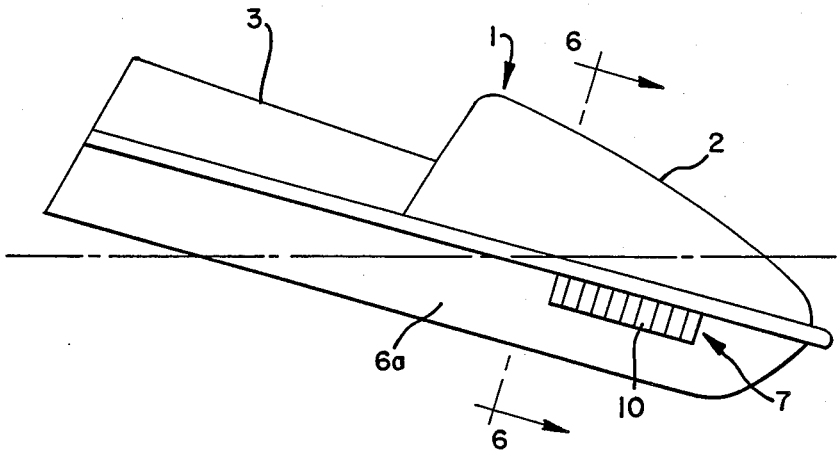
FIG. 5 is a side view of a craft illustrating a third embodiment of this invention.
Figure 6:
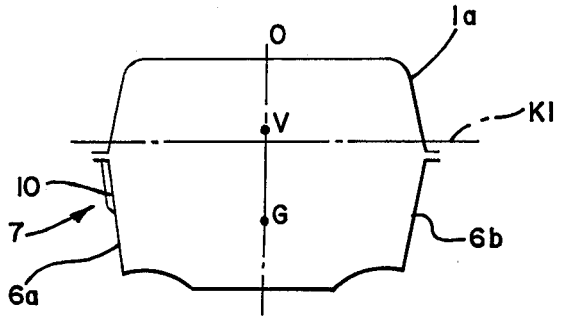
FIG. 6 is a sectional view taken on the line 6—6 of FIG. 5.

FIGS. 5 and 6 show a side view and a cross-sectional view of the hull of a craft according to a third embodiment of this invention. This form of the invention may be applied to a craft regardless of whether it has side shell flanges.

In this embodiment, the center of gravity G of the craft is set at a point within the vertical plane V containing the axis line 0 of the craft's hull. When the hull is trim while the craft is floating on the surface of the water with no operator riding on it, the hull is balanced from left to right and the sides 6*a* and 6*b* are equally submerged in the water. However, with this embodiment, a motion-resistance surface 10 made up of a series of ridges or similar shapes is provided on one side 6*a* of the craft at or below the water line K1 adjacent the prow of the boat. The ridges or other shapes extend outwardly from the side of the craft and run generally transversely of the direction of motion of the water past the side of the boat. This motion-resistance surface 10 creates a greater submerged motion resistance at the side 6*a* on which it is located, and thus it forms the motion-resistance means 7 of the invention.

It will be apparent from the foregoing that a novel and useful invention has been provided. In the event that the operator A falls off of the craft 1 during high-speed operation, the craft will immediately slow down and become trim with its prow 2 submerged below the surface of the water, and achieve the draft line K1 shown in FIG. 1A. Due to the self-propelling force of inertia and the jet propulsion force from the water jet exhaust port resulting from the engine being kept idling, the craft will continue its forward motion while reducing its speed. However, as a result of the craft having become trim with its prow 2 submerged beneath the surface of the water, the motion-resistance means provided on one side 6*a* of the craft in the area of the draft line of the prow 2 will also be submerged. This motion-resistance means creates a relatively strong resistance to the motion on one side of the craft, thus impeding the straight-line motion of the craft and causing the craft to circle continuously in the direction of the side 6*a* on which the motion-resistance means 7 is located.

Even in the event that the operator falls off of the craft during operation, not only will the boat immediately become trim with its prow submerged below the surface of the water, but the craft will automatically begin circling in the specified direction in a tight radius in the vicinity of the operator. Thus the operator will not lose sight of the craft and will be able to recover it more easily.

In addition, from a structural point of view, because the invention calls for the provision of a motion-resistance means on a part of the craft's hull which has absolutely no effect during normal operation, there is no need for special parts or movable members. Moreover, there is no effect on the balance of the operator during operation of the boat.

What is claimed is:

1. A relatively small water craft having a center of gravity and which, when in the water, has a draft line, said craft comprising a hull having a fore portion and an aft portion, said fore portion including an engine compartment and two sides and said aft portion including an operator's platform, one of said two sides having motion-resistance means thereon in the area of said draft line, said motion-resistance means being on said one side of said hull and causing greater interference with the smooth flow of water along said one side than along the opposite side, said hull having shell flanges which extend out horizontally from said sides, means in said hull placing said center of gravity at a point shifted to said one side from a vertical lane containing the longitudinal axis line of said hull and causing said hull to heel to said one side, said motion-resistance means being formed by said shell flanges on said one side.

* * * * *